US006431753B1

(12) United States Patent
Rogers et al.

(10) Patent No.: US 6,431,753 B1
(45) Date of Patent: Aug. 13, 2002

(54) BULK BAG WITH REMOTE DISCHARGE

(75) Inventors: Michael F. Rogers; Daniel E. Rogers, Jr., both of Crowley; Lionel Harrington, Lafayette, all of LA (US)

(73) Assignee: Acadia Industries, Inc., Crowley, LA (US)

( * ) Notice: Subject to any disclaimer, the term of this patent is extended or adjusted under 35 U.S.C. 154(b) by 0 days.

(21) Appl. No.: 09/693,066

(22) Filed: Oct. 20, 2000

(51) Int. Cl.[7] ..... B65D 33/24

(52) U.S. Cl. ..... 383/41; 383/24; 383/67; 383/86

(58) Field of Search ..... 383/41, 67, 22, 383/24, 86

(56) References Cited

U.S. PATENT DOCUMENTS

| | | | | | |
|---|---|---|---|---|---|
| 516,097 | A | * | 3/1894 | King et al. | 383/67 |
| 619,061 | A | * | 2/1899 | Wilson | 383/67 |
| 2,128,693 | A | * | 8/1938 | Dowd | 383/67 |
| 3,374,929 | A | * | 3/1968 | Silfverskiold | 383/67 |
| 3,827,471 | A | * | 8/1974 | Gregory et al. | 383/67 |
| 3,831,650 | A | * | 8/1974 | Consorti | 383/86 |
| 3,943,988 | A | * | 3/1976 | Consorti | 383/86 |
| 4,691,371 | A | * | 9/1987 | Derby | 383/67 |
| 4,811,419 | A | * | 3/1989 | Derby | 383/67 |
| 4,917,507 | A | * | 4/1990 | Davidson | 383/67 |
| 5,201,446 | A | * | 4/1993 | Martin | 383/67 |
| 5,328,267 | A | * | 7/1994 | Cuddy et al. | 383/24 |
| 5,344,048 | A | * | 9/1994 | Bonerb | 383/67 |
| 5,536,086 | A | * | 7/1996 | Nattrass | 383/67 |
| 5,738,443 | A | * | 4/1998 | Renaud | 383/67 |
| 6,132,090 | A | * | 10/2000 | Hashimoto | 383/67 |

FOREIGN PATENT DOCUMENTS

| | | | | |
|---|---|---|---|---|
| DE | 3434543 | * | 7/1986 | 383/24 |

* cited by examiner

*Primary Examiner*—Stephen P. Garbe
(74) *Attorney, Agent, or Firm*—Joseph L. Lemoine, Jr.

(57) ABSTRACT

Disclosed is a bulk bag with an improved device for securing the bag against inadvertent discharge of its contents during transportation and ordinary handling but is facilely operable remotely, from the side of the bag. Said improved device is characterized by discharge closure having plurality of sets of interlockable loops of fabric, at least one end of one loop in each set of loops which is releasable from the side of the bag and/or by a drawstring having a rope-lock releasable by lanyard attached to the side of the bag at a point which is covered by a flap or chute folded over said rope-lock and lanyard during transportation and handling of the bag. Accordingly both the interlockable loops and drawstring may be released from the side of the bag when discharge is desired.

13 Claims, 4 Drawing Sheets

BULK BAG WITH REMOTE DISCHARGE

BACKGROUND

1. Field of the Invention

In the field of transportation of flowable goods, various forms of Flexible Intermediate Bulk Containers, often called "bulk bags", are known. Such bulk bags typically have some means associated with the bottom of the bag for discharging the goods at a destination. During transportation said discharge means is typically closed by folding flaps of material over a discharge opening or by string-type closure of a discharge chute. The invention herein disclosed relates to a bulk bag having improved means for securing a bulk bag discharge means against inadvertent release during transportation and handling, yet is remotely operable when discharge is desired.

2. Description of Related Art

Various forms of Flexible Intermediate Bulk Containers, frequently called "bulk bags", are well known in the field of transportation of flowable goods, such as rice, sugar, flakes, molasses and the like. Such bulk bags are typically made of strong flexible fabric capable of supporting a heavy weight of goods without rupturing. Such bags may be equipped with strong lifting loops. Such bags may have strong webbing reinforcing the fabric. Typically such bags have closable openings at the top and bottom. The top opening is normally used to fill the bag with goods and the bottom opening is normally used to discharge goods from the bag.

Discharge of the material from the bag is normally accomplished by lifting the bag by its lifting loops, suspending it over some sort of receiving container, which is frequently a hopper having an operating auger therein for movement of the goods from the hopper to a continuous process, and releasing a discharge means at the bottom of the bag, thereby permitting the goods to discharge from the bag into the hopper.

A typical discharge means may be a flap of material associated with the bottom of the bag which is folded over the discharge opening during transportation, but is released when discharge is desired. Another form of discharge means which is common is some form of discharge chute or spout associated with the bottom of the bag which is closed by a tie during transportation, which tie is released to discharge if desired. All too typically release of the discharge means is not done remotely, but is accomplished by a person extending part of his body or a tool which may be dropped underneath the bag and over the receptacle to receive the goods (which is frequently a hopper with an operating auger) to actuate the discharge means. Discharge of goods from a bulk bag in this manner is less facile and safe than it need be.

Various prior art attempts to provide a discharge means that is remotely operable, that is, one whereby a person need not place part of his body under the bag or over the receptacle in which the goods are to be discharged in order to actuate the discharge means. One such attempt is seen in U.S. Pat. No. 5,340,218 to Cuthbertson. Therein is disclosed a bulk bag with a discharge spout. The discharge spout is folded against the bag and covered with a closure flap. A pull strap is connected to the flap. The pull strap has a sufficient length for a portion thereof to extend beyond the vertical sides of the bag, permitting a person to pull the strap without placing himself under the bag. When the flap is pulled open the spout is intended to unfold under the weight of the goods and discharge the goods through the spout and from the bag. A potential disadvantage of a bag of this design is the risk of inadvertent discharge if the pull strap is snagged and accidentally pulled during transportation or handling of the bag.

U.S. Pat. Nos. 5,738,443 and 5,975,759, both to Jean-Jacques Renaud, represent another attempt to provide a remotely operable discharge mechanism on a "full open" bulk bag. In these patents, the bottom of the bulk bag is comprised of a plurality of flaps each of which is permanently attached to different sides of the bag. To close the bag the flaps are folded over each other and the last flap secured by straps to buckles on the side of the bag. To discharge the contents of the bag, the straps are released from the buckles, permitting the bottom of the bag to open and the contents to be discharged. A cord or lanyard is attached to the buckles to facilitate their operation remotely. A potential disadvantage of this design is the use of rigid buckles creates a risk of tearing or puncturing the bag on which they are installed or adjacent bags. Another potential disadvantage of this design is the risk of inadvertent discharge if buckles are accidentally lifted by contact with adjacent objects or the lanyard is accidentally snagged during transportation or handling of the bag.

The bulk bag herein disclosed and claimed is designed to address these potential disadvantages:

3. Objects of the Invention

The general object of the present invention is to provide Flexible Intermediate Bulk Container ("bulk bag") having the advantages of prior art, that is to provide a strong flexible container useful for transportation and handling of flowable goods, but provide improved means for discharging such bags. More particularly an object of the present invention is to provide a bulk bag having a discharge means which is facilely operable from a remote position, that is, the operator need not place part of his or her body or any tool which may be dropped under the bag in order to operate its discharge. Yet another object of this invention is to provide a bulk bag having a discharge means which may not only be facilely operated remotely but is also secure against inadvertent operation during ordinary transportation or handling of the bag.

SUMMARY OF THE INVENTION

The above objects are achieved in accordance with the present invention wherein there is provided a bulk bag wherein a discharge means associated with the bottom of the bag is folded to a side of the bag, where it is there attached by sets of interlocking loops of webbing, at least one end of at least one loop in each set which is releasable. Said releasable end may be secured against inadvertent release by a second, transversely disposed, also releasable loop of webbing. The bag may be further secured against inadvertent discharge goods by drawstring, secured by a rope lock which is remotely releasable by lanyard extending to the side of the bag. During transportation and handling of the bag, the rope lock and lanyard may be secured against inadvertent operation by folding a portion of the discharge chute or a separate flap over them and securing said chute or flap to the side of the bag by the sets of interlocking loops of webbing herein described. Yet another object of the invention is to provide means for securely closing and remotely releasing the discharge of a bulk bag without use of rigid and sharp components which may tear or puncture the bulk bag or adjacent containers.

BRIEF DESCRIPTION OF THE DRAWINGS

The invention will be better understood by reference to the accompanying drawings wherein.

DESCRIPTION OF THE PREFERRED EMBODIMENT OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. It is therefore intended that the present invention not be limited to the particular embodiments disclosed as the best mode contemplated for carrying out this invention, but that the invention will include all embodiments (and legal equivalents thereof) falling within the scope of the appended claims.

Figure 1:
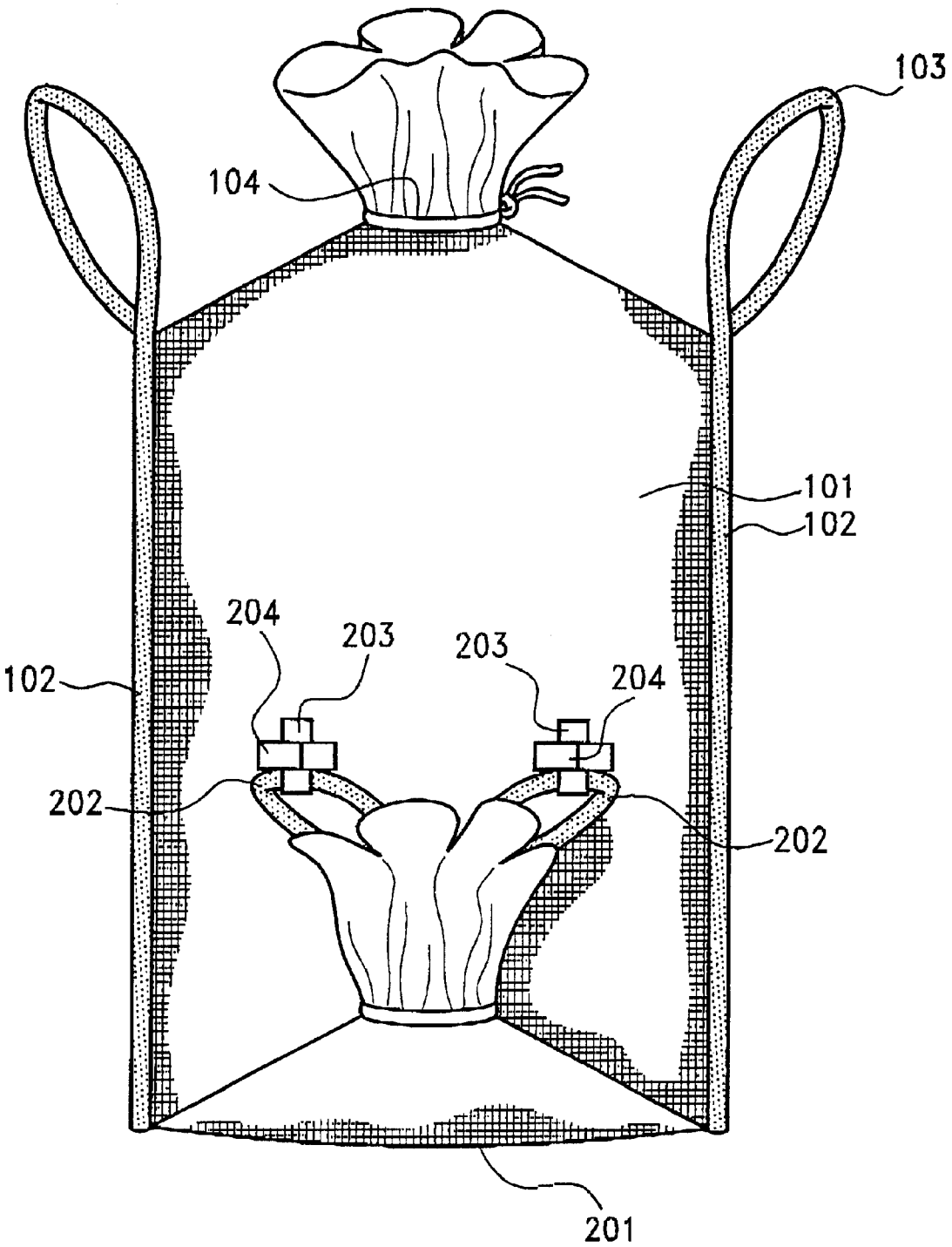
FIG. 1 is a plan view of the front of the bulk bag of the preferred embodiment of the present invention with discharge means secured to the side of the bag.
Figure 2:
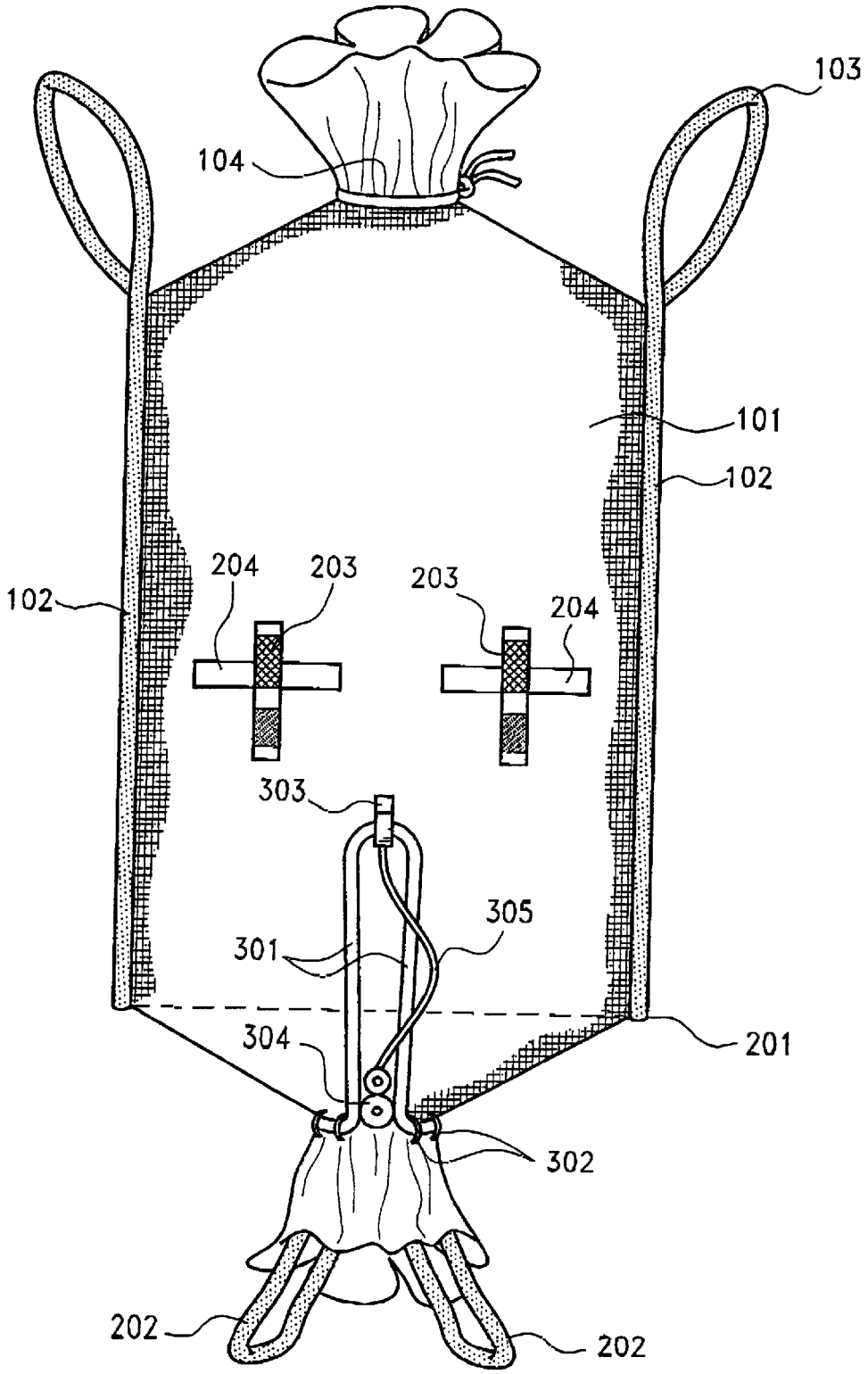
FIG. 2 is a plan view of the front of the bulk bag of the preferred embodiment of FIG. 1 of the present invention with discharge means released from the side of the bag but its drawstring closure not yet opened.
Figure 3:
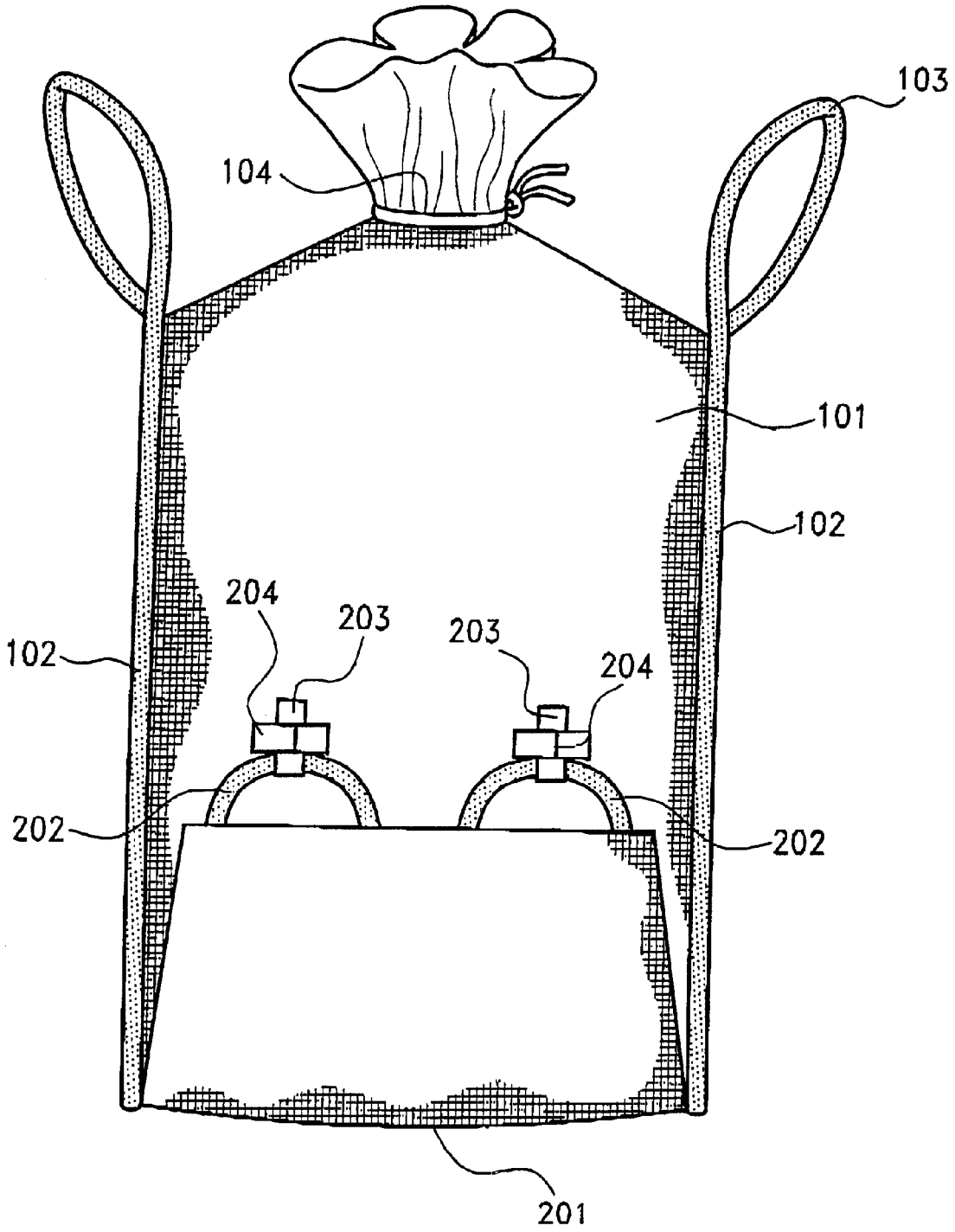
FIG. 3 is a plan view of the front of the bulk bag of an alternative embodiment of the present invention (without drawstring closure) with discharge flap secured to the side of the bag.
Figure 4:
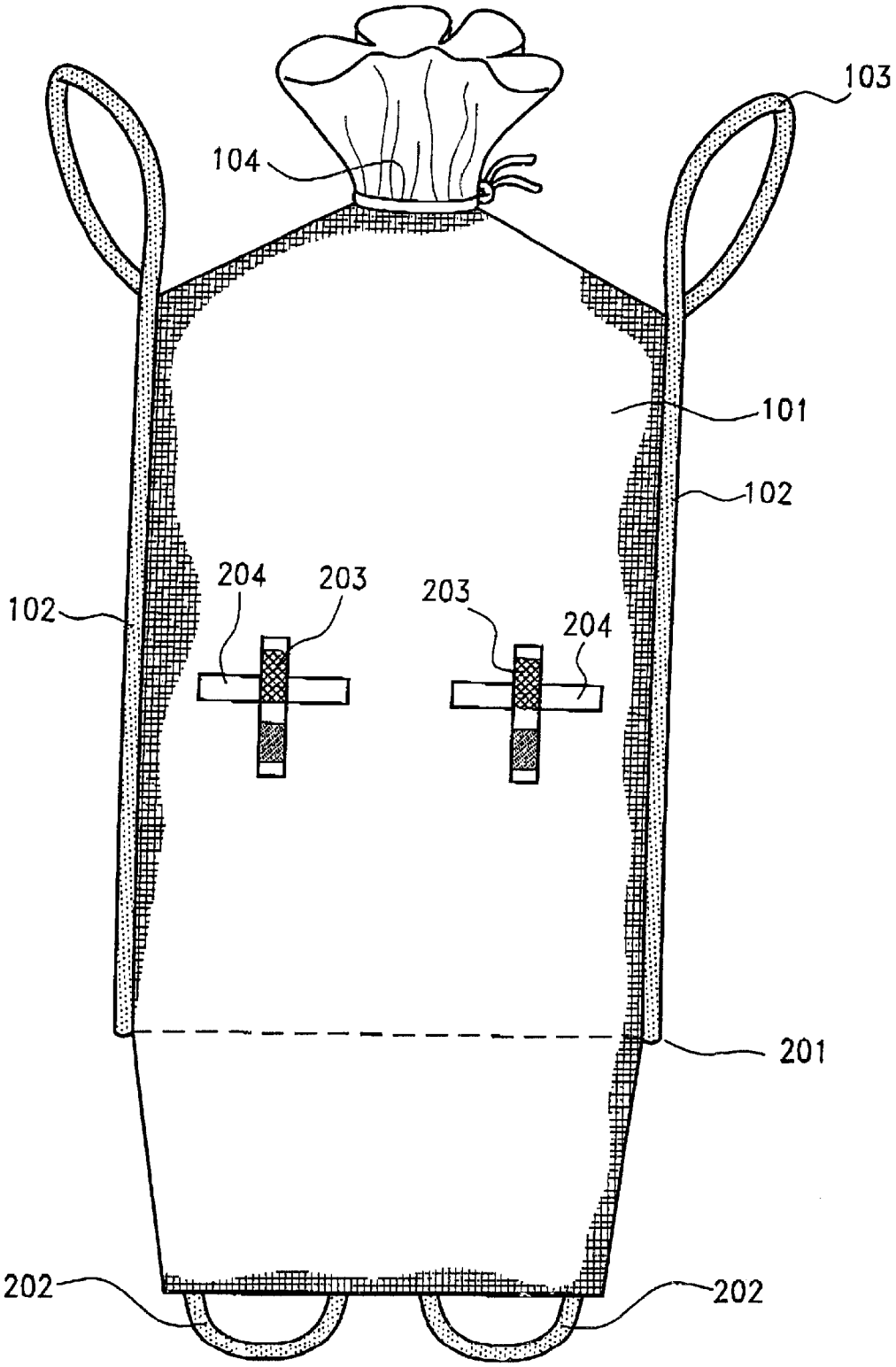
FIG. 4 is a plan view of the front of the bulk bag of the alternative embodiment of FIG. 3 with discharge flap released from the side of the bag.

The preferred embodiment of the bulk bag of the present invention is generally characterized in FIG. 1. Its sides 101 may be comprised of any strong, flexible, burst resistant fabric. A fabric of woven strips of polypropylene is strong, economical and is known to be particularly suitable for forming bulk bags. Disposed interior of sides 101 may or may not be a moisture impervious liner (not shown). If used, said liner may or may not be attached to the interior of sides 101 by various means, including gluing, stitching or both. The top, sides or bottom of the bag may be reinforced by a web of strong material such as woven polypropylene, polyester, nylon or like strapping, 102. Disposed at or near the top of the bag, lifting loops 103 may be attached, by stitching, gluing, riveting or like permanent fastening means. Such loops are typically comprised of a strong material such as woven polypropylene, polyester, nylon or like strapping. In the typical construction the bag will have opening 104 for filling the bag.

The bottom of the bag may have a discharge of some form such as cone shaped, full-open bottom, full-open duffle style or flat-bottom with spout. In each case it is necessary that said discharge be secured against inadvertent release of goods during transportation and ordinary handling of the bag, yet be facilely releasable when desired, preferably without the necessity of requiring personnel to place any part of their body, or tools which may be dropped, under the bag or over the receptacle in which the goods are to be discharged, particularly if that receptacle contains moving components such as an auger. To this end, the discharge means of the bulk bag, whether it be a flap-like or a chute-like discharge means, of the present invention is designed to be folded against the bottom of the bag and have a terminal edge which extends at least to the side of the bag and may extend beyond, onto at least a portion of a side of the bag. Attached proximate to said terminal edge of the discharge means are a plurality of bottom loops 202, each of which is designed to be interlocked with a mating side loop 203 which is attached to the side of the bag. Said loops are made of strong flexible material such as woven polypropylene, polyester, nylon or like strapping In the preferred embodiment of the invention both ends of bottom loops 202 are permanently secured to the bag by stitching, gluing, riveting or like permanent fastening means. However in alternative embodiments of the invention one or both ends of loop 202 could be attached by hook and loop fastening material ("Velco™"), snaps, buttons or like releasable means. In the preferred embodiment of the invention only one end, preferable the upper end, of side loops 203 is permanently secured to the bag, by stitching, gluing, riveting or like permanent fastening means. In said preferred embodiment the second end of side loops 203 are designed to be releasably attached either back to the first end of itself or to the side of the bag, by hook and loop fastening material ("Velco™"), snaps, buttons or like releasable means. Likewise, in alternative embodiments, both ends of side loops 203 could be permanently or releasably attached, providing at least one end of either bottom loops 202 or side loops 203 is releasable, so that each set of corresponding loops may be interlocked with (and when desired released from) its mating loop.

Also provided in the preferred embodiment of the invention, are locking loops 204. Said locking loops are made of a strong flexible material such as woven polypropylene, polyester, nylon or like strapping. In the preferred embodiment said locking loops are disposed transversely side loops 203. In said preferred embodiment an intermediate portion of loop 204 is permanently attached to the side of the bag, by stitching, gluing, riveting or like permanent fastening means. The ends of locking loops 204 are free from the side of the bag but are designed to be releasably attached to each other, by hook and loop fastening material ("Velco™"), snaps, buttons or like releasable means. Each locking loop 204 is designed to be secured over a corresponding side loop 203 after both ends of side loop 203 are secured, either back to itself or to the side of the bag, to secure a corresponding side loop 203 against inadvertent release.

In use, the discharge means of the preferred embodiment of the invention is folded to the side of the bag, corresponding sets of bottom loops 202 and side 203 interlocked with each other on the side of the bag and a corresponding locking loop 204 secured over each side loop 203 before the bag is filled. A filled bag of the preferred embodiment of the invention is typically discharged by suspending it over a receptacle in which the goods are to be discharged. There suspended, locking loops 204 and side loops 203, which are at the side of the bag, may be released permitting weight of the goods to push the discharge means downwardly and the contents of the bag to be discharged therefrom (if discharge is prevented by other means). The above-described means of closure is thus both secure against inadvertent release of goods but may be facilely released from the side of the bag.

However, as further security against inadvertent release of the goods the preferred embodiment of the invention is also provided with additional means of closure, which is remotely releasable by drawstring means. Thus in said preferred embodiment, drawstring 301 extends circumferentially, through loops 302, about any chute-like discharge, whether full-open or otherwise. When drawstring 301 is tightened it will temporarily have excess length. In the preferred embodiment of the invention said excess length is secured to the side of the bag by strap of material 303, one end of which is releasable so as to permit the drawstring to extend about the full circumference of the discharge means when it is fully opened. Strap of material 303 is attached to the side of the bag at a point on said side which will be covered by the discharge chute when said discharge chute is folded to and secured to the side of the bag as discussed above. Until released drawstring 301 is maintained in a tightened position by rope-lock, 304, such as Model B-Lock-5 manufactured by ITW Nexxus. Rope-lock 304 is releasable by lanyard 305, one end of which is attached to the rope-lock and the other of which is attached to the side of the bag at a point which will be covered by the discharge chute when said discharge chute is folded to and secured to the side of the bag as discussed above.

Thus, in the preferred embodiment of the invention, the bag disclosed is seen to have several, redundant means for securing it against inadvertent discharge of its contents, yet each of said means is facilely releasable from the side of the bag. In the first instance, because side loops 203 are secured against inadvertent release by locking loops 204, it is unlikely that a single set of interlocking loops (each set comprised of one bottom loop 202 and its mating side loop 203) will be inadvertently released. In the second instance, since there are a plurality of sets of mating loops it is unlikely that release of a single set would permit contents of the bag to discharge. Additionally when drawstring means is closed drawstring 301 is locked against inadvertent release by rope-lock 304. Finally, since rope-lock 304 and the lanyard 305 are covered by the folded and secured discharge chute during transportation and ordinary handling of the bulk bag, it is unlikely the drawstring means will be inadvertently operated during same. Yet when discharge is desired, each of said several, redundant means may be facilely operated, from the side of the bag, without the necessity of a person placing either part of his body or a tool that may be dropped either under the bag or over the receptacle into which the goods are to be discharged. To discharge the bag all such person need do is release locking loops 204 and side loops 203, pull lanyard 305 and the goods then discharge under their own weight.

It is thus to be appreciated that the bulk bag constructed in accordance with the principles and teachings of the present inventive disclosure constitutes an advancement in the bulk bag art. While the above description contains certain specificities, these should not be construed as limitations on the scope of the invention, but rather only as an exemplification of preferred embodiments thereof. Accordingly, the scope of the present invention should be determined not only by the embodiments illustrated, but by the appended claims and their legal equivalents.

What is claimed is:

1. A bulk bag for transportation and handling of flowable goods, comprising:

(a) a fabric bag having a top portion, a plurality of side wall portions and a bottom portion having a designated edge, together defining a storage space therewithin;

(b) an opening disposed in said top portion;

(c) an opening disposed in said bottom portion;

(d) at least one flap of fabric having a first edge attached to said bulk bag and having an opposite edge which extends a sufficient distance beyond said bottom portion to completely cover the opening disposed in said bottom portion and extend at least to said designated edge of said bottom portion when said flap is folded toward said designated edge;

(e) a plurality of first loops of fabric attached to said flap proximate said opposite edge thereof;

(f) for each of said plurality of first loops, a corresponding strap of fabric having a first end which is attached to said designated side wall portion and a second end which is releasably attachable to said first end of said strap, when so attached each of said straps forming a second loop of fabric which is interlockable with a corresponding first loop of fabric; and, (g) a plurality of locking loops, each of which is attached to said designated side wall portion and is disposed transversely around a corresponding second loop of fabric.

2. The bulk bag of claim 1 wherein said locking loops are comprised of a strap of fabric having an intermediate portion attached to said designated side wall portion of the bulk bag and having ends releasably attachable to each other.

3. A bulk bag for transportation and handling of flowable goods, comprising:

(a) a fabric bag having a top portion, a plurality of side wall portions and a bottom portion having a designated edge, together defining a storage space therewithin;

(b) an opening disposed in said top portion;

(c) an opening disposed in said bottom portion;

(d) a fabric chute attached to said bottom portion, said chute having an end extending a sufficient distance beyond said bottom portion extend at least to said designated edge of said bottom portion when said chute is folded toward said designated edge;

(e) a plurality of first loops of fabric attached to said chute proximate said end thereof; and, (f) for each of said plurality of first loops, a corresponding strap of fabric having a first end which is attached to said designated side wall portion and a second end which is releasably attachable to said first end of said strap, when so attached each of said straps forming a second loop of fabric which is interlockable with a corresponding first loop of fabric.

4. The bulk bag of claim 3, wherein said second end of each said strap of fabric is releasably attached to said designated side wall portion of the bulk bag, when so attached each of said straps of fabric forming a second loop which is interlockable with a corresponding first loop of fabric.

5. The bulk bag of claim 3, further comprising a plurality of locking loops, each of which is attached to said designated side wall portion and is disposed transversely around a corresponding second loop of fabric.

6. The bulk bag of claim 5 wherein said locking loops are comprised of a strap of fabric having an intermediate portion attached to said designated side wall portion of the bulk bag and having ends releasably attachable to each other.

7. The bulk bag of claim 3 further comprising a drawstring circumferentially surrounding said chute.

8. The bulk bag of claim 7 wherein said drawstring is disposed through a rope-lock which is releasable by lanyard.

9. The bulk bag of claim 8 wherein said lanyard is attached to a point on the side wall portion of the bulk bag which will be covered by a portion of the chute when said chute is secured to said side wall portion by interlocking said first and second loops of fabric.

10. A bulk bag for transportation and handling of flowable goods, comprising:

(a) a fabric bag having a top portion, a plurality of side wall portions and a bottom portion having a designated edge, together defining a storage space therewithin;

(b) an opening disposed in said top portion;

(c) an opening disposed in said bottom portion;

(d) a fabric chute attached to said bottom portion;

(e) at least one flap of fabric having a first edge attached to said bulk bag and having an opposite edge which extends a sufficient distance beyond said bottom portion to completely cover the opening disposed in said bottom portion, the fabric chute and extend at least to said designated edge of said bottom portion when said fabric chute and flap are folded toward said designated edge;

(f) a plurality of first loops of fabric attached to said flap proximate said opposite edge thereof;

(g) for each of said plurality of first loops, a corresponding strap of fabric having a first end which is attached to said designated side wall portion and a second end which is releasably attachable to said first end of said strap, when so attached each of said straps forming a second loop of fabric which is interlockable with a corresponding first loop of fabric; and, (h) a plurality of locking loops, each of which is attached to said designated sidewall portion and is disposed transversely around a corresponding second loop of fabric.

11. The bulk bag of claim 10 wherein said locking loops are comprised of a strap of fabric having an intermediate portion attached to said designated side wall portion of the bulk bag and having ends releasably attachable to each other.

12. The bulk bag of claim 10 further comprising a drawstring circumferentially surrounding said chute, wherein said drawstring is disposed through a rope-lock which is releasable by lanyard.

13. The bulk bag of claim 12 wherein said lanyard is attached to a point on the side wall portion of the bulk bag which will be covered by a portion of the flap when said flap is secured to said side wall portion by interlocking said first and second loops of fabric.

* * * * *

UNITED STATES PATENT AND TRADEMARK OFFICE

CERTIFICATE OF CORRECTION

PATENT NO. : 6,431,753 B1 
DATED : August 13, 2002
INVENTOR(S) : Michael F. Rogers, Daniel E. Rogers, Jr. and Lionel Harrington It is certified that error appears in the above-identified patent and that said Letters Patent is hereby corrected as shown below:

Column 6,
Line 25, element (d), before the word "extend", the word -- to -- is added.

Signed and Sealed this

Twentieth Day of January, 2004

JON W. DUDAS
*Acting Director of the United States Patent and Trademark Office*